73-151.5 SR
10/7/85 XR 4,616,321

United States Patent [19]

Chan

[11] Patent Number: 4,616,321

[45] Date of Patent: Oct. 7, 1986

[54] DRILLING RIG MONITORING SYSTEM

[76] Inventor: Yun T. Chan, Hanover St., Aberdeen, Scotland

[21] Appl. No.: 536,053

[22] Filed: Sep. 26, 1983

Related U.S. Application Data

[63] Continuation-in-part of Ser. No. 181,484, Aug. 26, 1980, abandoned.

[30] Foreign Application Priority Data

Aug. 29, 1979 [GB] United Kingdom ..... 7929874

[51] Int. Cl.[4] ..... G06F 15/20; E21B 47/04

[52] U.S. Cl. ..... 364/422; 73/151.5

[58] Field of Search ..... 364/420–422; 73/151, 151.5; 367/25, 33; 324/324, 338, 346, 351, 355, 366

[56] References Cited

U.S. PATENT DOCUMENTS

| | | | |
|---|---|---|---|
| 3,643,504 | 2/1972 | Rundell | 73/151.5 |
| 3,777,560 | 12/1973 | Guignard | 73/151.5 |
| 3,785,202 | 1/1974 | Kelseaux et al. | 73/151.5 |
| 3,853,004 | 12/1974 | Westlake et al. | 73/151.5 |
| 3,891,038 | 6/1975 | Delestrade et al. | 73/151.5 |
| 3,916,684 | 11/1975 | Rundell | 73/151.5 |
| 3,931,735 | 1/1976 | Guigmard | 73/151.5 |
| 4,156,467 | 5/1979 | Patton et al. | 73/151.5 |

*Primary Examiner*—Gary Chin
*Attorney, Agent, or Firm*—Gerald J. Ferguson, Jr.; James E. Bryan; Michael P. Hoffman

[57] ABSTRACT

In a drilling rig of drill depth conventional structure, parameters of interest (e.g. rate of penetration and drill bit location, number of stands, monkey board position) are calculated and displayed by a unified electronic system. A weight transducer measures the load of the drill string on the rig. A movement sensor provides information on movement of the hook. An internal clock provides time signals. The relevant parameters are calculated using a microprocessor from these three factors.

10 Claims, 5 Drawing Figures

DRILLING RIG MONITORING SYSTEM

This invention relates to a system for acquiring operational data in a drilling rig.

In conventional oil drilling rigs, data is acquired and displayed by separate instruments for the various parameters of interest. The instruments used are electromechanical or purely mechanical, and they have poor accuracy and low reliability in the arduous conditions usually present in drilling rigs.

The system of the present invention is based on the need in the oilwell drilling field for a reliable, accurate and trouble free drilling instrument. During the past, and even up to the year 1979, drilling instruments commercially available were mechanical-hydraulic or mechanical-electronic systems such as those produced by Martin-Deckar of San Anna, Calif., Totco of Norman, Okla. and Geolograph of Oklahoma City, Okla.

The majority of sensors utilized by such instruments contained mechanical movement which is subject to wear and tear or complete failure due to the environmental conditions normally encountered in the drilling industry.

U.S. Pat. No. 4,156,467 (Patton et al) shows one form of electronic instrumentation, using sensors which are located at the draw-works drum and utilise the Hall-effect to detect magnetic markings which are fastened to the flange of the drum. However, sensing the magnetic strips attached to the flange of the drawworks drum is only good in theory. Configuration of drawworks is different with different manufacturers. Normally the rim is not easily accessible. Installation of the magnetic strips will mean practically dismantling the drawwork which is not acceptable practice.

During normal operation, the lubricant from the drilling line builds-up on the magnetic strip and the Hall-effect sensors, and consequently affects its effectiveness.

The rims of the drawworks drum are not machined surfaces so attaching magnetic strip cannot be carried out satisfactorily, and the distance between the sensors and the strip can vary more than a Hall-effect sensor sensing distance.

Furthermore, using the layer of cable and the cable diameter, etc. (disclosed in Patton et al) as factors of depth measurement again is not practical. The cable is not necessarily wound on the drum uniformly every time and any wear on the cable can effect the measurement.

It is more practical to have the depth sensor mounted on the crown block and sense the movement of the fast line pulley because the fast line pulley is readily accessible on almost any type of drilling rig.

Furthermore, it is not likely for the sensor to get knocked off in normal operation and the tar oil normally used for drilling line lubrication will not build up in the sensing area. Normally no modification is required on the fast line pulley. The probes simply sense the spokes or holes normally existing on the pulley or simply attached small metal pieces on the side.

All of the above represent a practical and workable method. By using this method, the system of the present invention can be installed in almost any drilling rig and provide maintenance free and trouble free data gathering.

With the improvement of drilling techniques, looking for oil in more hostile geographical areas and the introduction of new safety legislation, the conventional drilling instrumentation with its fundamental handicaps is not able to fulfill the requirements.

The system of the present invention is unique from any other system in that it provides a practical approach in the method of sensing the information, the installation of sensors and the method in which it presents the vital drilling information to the operator.

It offers the driller reliable information which requires no human interference during normal operation. The installation is simple, practical and easily accessed; it will not foul-up due to the environmental factor; in simple terms it is a driller's tool, it is practical and it works well.

An object of the invention is to provide a significant improvement on known arrangements, and to provide an integrated electronic system with no (or very few) moving parts. A further object is to provide drilling data which cannot be obtained by existing instruments.

The invention accordingly provides, in a drilling rig having a derrick including a crown block and a travelling block operable to lift pipe lengths to assemble and disassemble a drill string, and a rotary table engagable with the drill string to rotate it, an improved instrumentation system comprising:

a weight transducer mounted to provide a weight signal which is a function of the weight of the drill string on the rig;

sensing means arranged to provide a signal representative of movement of the travelling block;

clock means providing a timing signal;

calculating means connected to receive the weight signal, the movement signal and the timing signal to calculate therefrom the weight on bit and rate of penetration;

said calculating means having a memory for storing data defining the relationship between the length and weight of the drill string, said calculating means further being arranged to calculate true drilling depth from the weight signal, the movement signal and said stored data; and a unitary display means arranged to make all of said signals and parameters available to an operator.

The system also provides detection of approach of the elevator (travelling block) to a fixed part of the rig structure, such as the monkey platform, and the crown block and to an alarm in response thereto.

The invention will now be described in more detail, referring to the accompanying drawings, in which.

Figure 1:
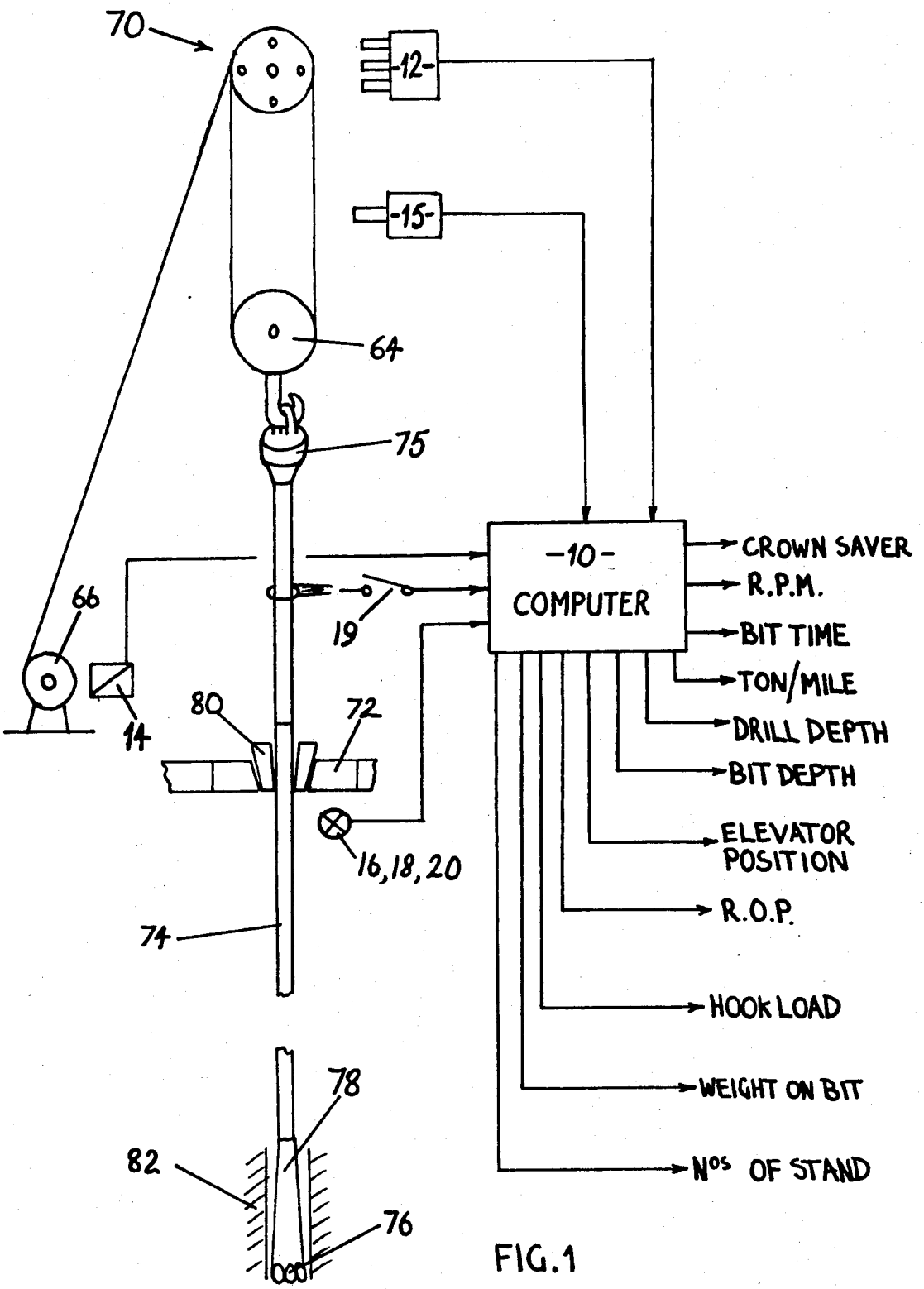
FIG. 1 shows a diagram of the system of the present invention used in conjunction with conventional drilling apparatus.
Figure 2:
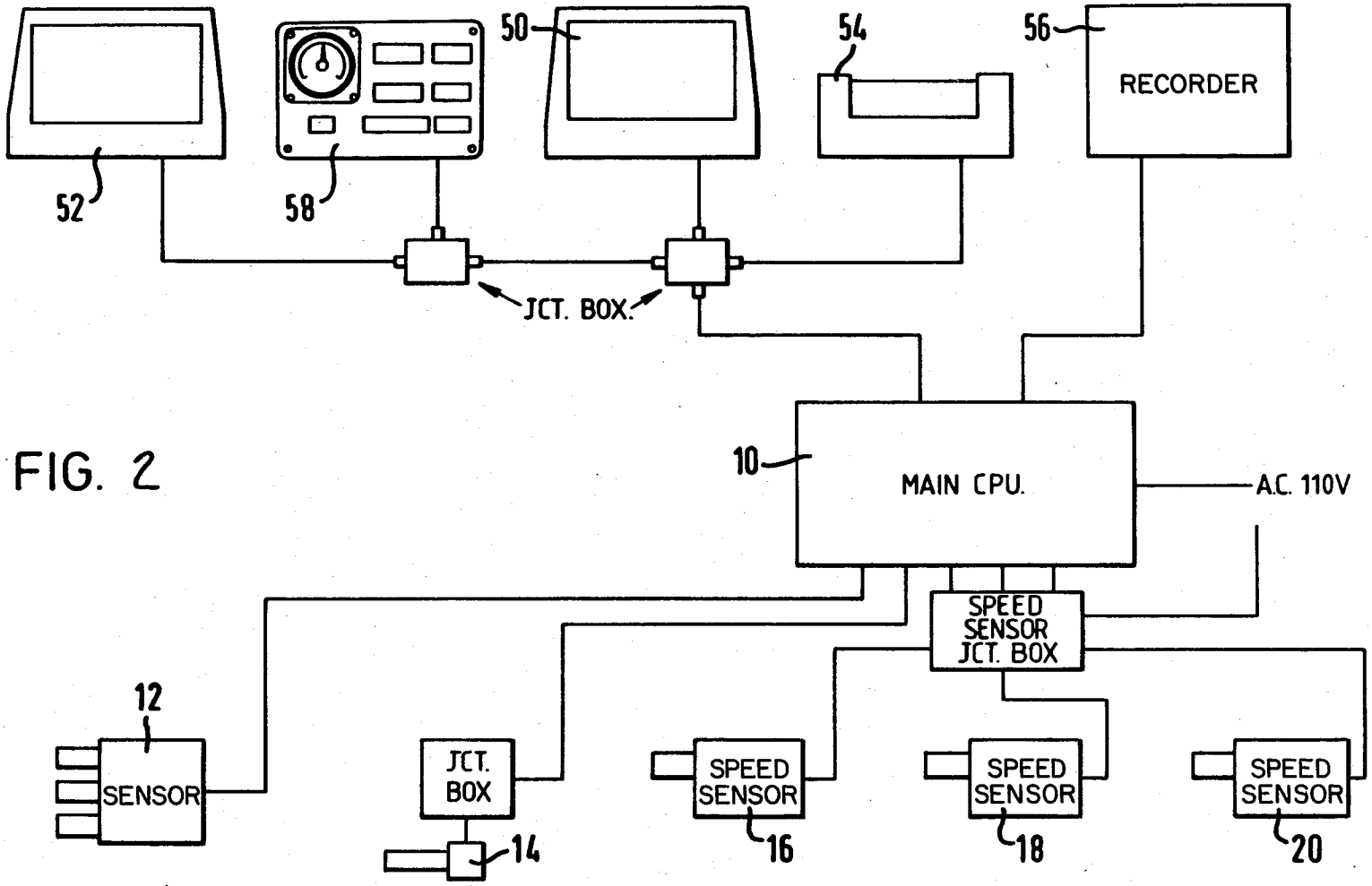
FIG. 2 is a block diagram illustrating one embodiment of the invention.

Referring to FIG. 1, the conventional drilling apparatus comprises a crown block assembly 70 which supports a travelling block 64. A dead line anchor 66 is operated to lower and raise the travelling block 64. A number of drill pipes 74 are attached to the travelling block 64 via a Kelley 75. The pipes 74 are rotated by means of a rotary table 72 and a slip 80. A driller collar 78 and a drill bit 76 are located at the remote end of the drill pipes 74 for drilling through the earth formation 82. The system of the present invention is based on a computer 10 utilising a microprocessor of known type, suitably a Z80 microprocessor by Zilog. The computer 10 receives signals from a depth sensor 12, a weight sensor 14, an elevator sensor 15, a tong torque switch 19 and rotary table speed sensors 16,18 and 20, and processes these to provide drilling data to output peripherals.

The weight sensor 14 is installed at the dead-line anchor 66 or at the crown block 70 to give a signal representative of the load of the entire drill string acting on the drilling rig. Information such as hook load, weight on bit, number of stand and accurate depth measurement can then be obtained.

The weight sensor 14 may suitably be a strain guage.

The elevator sensor 15 is installed near the moving path of the travelling block 64, to check and reset its position. This is especially important when the cable in the pulley assembly has slipped and cut after it has worn to the limit. By installing this elevator sensor 15 the travelling block 64 is monitored at all times. Therefore information like monkey board position, crown alarm and crown stop can be obtained and dangerous block collisions can be avoided.

The tong torque switch 19 is provided to sense the usage of the tong. This is also a unique feature of the present drilling computer system. By using this signal, together with the weight and depth signals and the computer memory, the computer 10 can establish precisely and automatically the status of the process: whether it is a drilling process or a tripping process or a non-drilling related function.

Rotary-table speed sensors 16,18 and 20, located at the rotary table 72 are included in the drilling computer system to sense the turning rate of the drillbits for controlling or optimizing the speed of drilling through a given earth formation.

Figure 4:
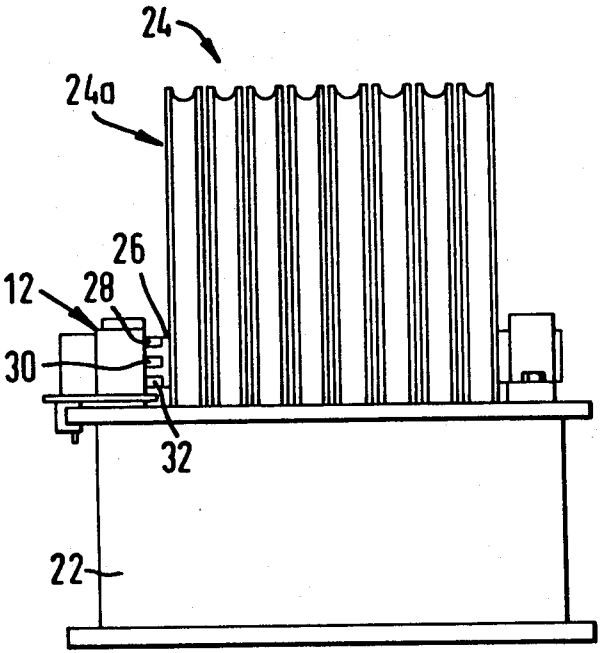
FIG. 4 is an end view of the crown block assembly of FIG. 3.
Figure 3:
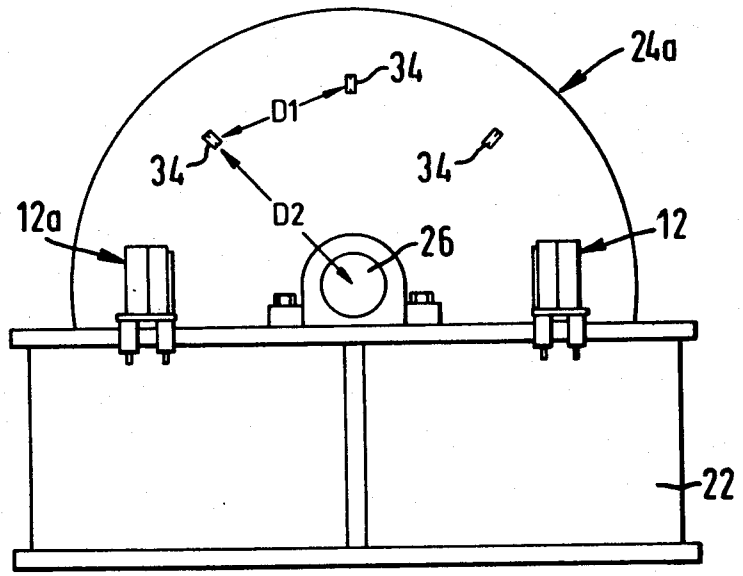
FIG. 3 is a side view of a crown block assembly carrying a sensor used in the system of FIG. 1.
Figure 5:
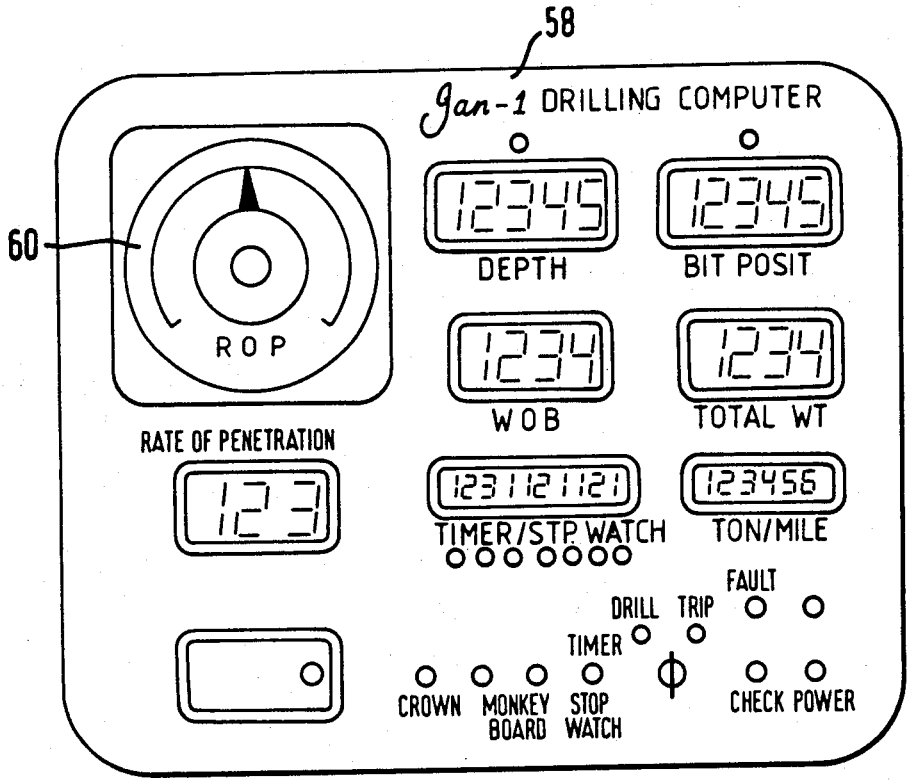
FIG. 5 illustrates a drillfloor unit used in the system of FIG. 1.

The depth sensor 12 is illustrated in greater detail in FIGS. 3 and 4. The depth sensor is installed at the crown block assembly 70 of the drilling rig derrick near the fast line pulley 24*a*. This location is readily accessible for installation of the sensors; normally no dismantling of machinery or modification is required. The crown block assembly 70 includes a base 22 secured to the drilling derrick, and pulleys 24 independently rotatable on a pulley shaft 26 journalled in the base 22, as is conventional. The sensor 12 is secured to the base 22 adjacent the fast line pulley 24*a*, and comprises three magnetic proximity detectors, or photo-cell mark detectors 28,30,32 which produce output pulses when passed by mild steel pieces 34 secured to the adjacent face of the fast line pulley 24*a*. There are suitably eight pieces 34 equispaced about the pulley 24*a*, the positioning being such that the distance $D1=2\times D2\times \sin 22.5°$; the distance D2 is not critical and can conveniently be 400–500 mm. Eight strips of white paint are used as marks in place of mild steel pieces when using the photo-cell marker detector. Instead of attaching steel pieces 34, the magnetic proximity detectors can sense spokes or holes, where these are present in the fast line pulley.

The centre detector 30 is used to provide datum pulses which can be switched with the pulses from the detectors 28, 32 to distinguish forward and reverse movement. Thus the sensor 12 provides an output to the computer 10 comprising (1) a signal distinguishing forward and reverse, and (2) a pulse signal wherein each pulse indicates a unit of distance travelled by the travelling block, and the pulse rate indicates the speed of movement. The depth sensor is unique; it uses three sensing probes and is arranged in such a way that only the logic of 1-2-3 represents the up movement and 3-2-1 represent the down movement. No misrepresentation is possible with this simple method, rather than using magnetic strip and Hall-effect sensor.

The sensors are proximity sensors. They sense the target at a greater distance and can sense any piece of metal, therefore no precise alignment is necessary.

A duplicate sensor 12*a* is provided as a standby.

The above signals are processed by techniques known per se in the computer 10, together with time signals generated by an internal clock, to generate parameters of interest as detailed below.

(1) True drilling depth is derived by reading movement of the crown block pulley and accumulating the total for downward movement only. The total depth thus derived is a nominal depth equal to the unstretched length of the drill string. The microprocessor of the present apparatus is provided with memory and program data to allow a corresponding algorithm to be performed to calculate true depth for immediate display. The memorised data is suitably provided in an EPROM, which can readily be set up initially with information relevant to the specific rig.

(2) Rate of penetration (ROP) is derived by dividing the drilling depth signal by time.

(3) Drill bit location is derived by accumulating both upward and downward movement of the crown block pulley when under load.

(4) Trip speed (i.e. the speed of the drill string while being removed from the drill hole) is derived by dividing the upward movement of the crown block pulley by time, during upward movement under load.

(5) The ton/mile reading of the drill line is derived from the total travel of the cable of the travelling block/crown block assembly and the weight on the travelling block. Thus total work done on the cable is measured, which is vital for evaluation of the safe life of the cable.

(6) Hook load indication comes directly from the drill string transducer signal.

(7) Weight on bit (WOB) is developed by storing total hook load before the bit is at bottom and subtracting from this the instantaneous hook load.

(8) Digital timer and stop watch functions are supplied by the clock circuit.

The system also enables the information from the crown block sensor to be used to generate safety signals, by initially storing in the memory of the computer 10 data representing the position of the elevator relative to the monkey board and the permissible range of movement of the (travelling block) elevator relative to the crown block. Thus:

(9) A signal representing the relative position of the elevator to the crown block and to the monkey board is developed from the movement of the crown block pulley and activates an alarm if the travelling block approaches within a safe limit from the crown block.

The paramaters derived by the computer 10 can be output to a range of peripherals as shown in FIG. 1, such as a local VDU 50, a remove VDU 52, a printer 54, a recorder 56 (e.g. a chart plotter or a multi-track tape recorder or magnetic tape/disc recorder), and a drillfloor unit 58. The drillfloor unit, shown in greater detail in FIG. 4, is positioned on the drillfloor for use by the drilling crew. The rate of penetration is displayed by a meter 60 since this accords with traditional drillfloor practice, and the other parameters on digital displays.

The availability of the computer 10 permits the monitoring of other functions to be easily added. For example, as shown in FIG. 1, the additional sensors 16,18,20 may supply the computer with speed data for the rotary table and two mud pumps, respectively, for suitable display or recording.

Before drilling has begun, the travelling block weight is registered into the computer 10. The length of the drill pipe 74 is also registered, when the pipes are joined up with the drill-bit 76 and drill collar 78 at the other end. The depth sensor 12 measures the length of each pipe, the weight sensor 14 registers the weight increase during the Kelley hoist-up of the pipe to be added on. When the pipe is joined onto the length of pipe just being drilled with the tong torque being used to tighten-up the joint, using the tong trigger, the tong switch 15 in turn instructs the computer 10 to stop the process of bit depth regardless of weight changes on the travelling block 64 (hook). When the connection is completed, the travelling block 64 moves slightly upward to enable the removal of the slip 80, at the same time the total weight is applied to the hook, which is considerably larger than the travelling block weight. This instructs the computer 10 to start up-dating the bit depth measurement. When the bit depth reaches the previously drilled depth, the depth begins to up-date, as do the rate of penetration, bit time, weight on bit, etc. When the added-on length has been drilled through, the hook moves back to the previous location, the drill depth remains at the last reading, but the bit depth reads the distance above the depth. The slip is set and the hook load returns to the empty block weight. During this time the bit depth stops processing and the number of stand is increased $\frac{1}{3}$ stand. When the tong torque is used to disconnect the Kelley, it further advises the computer 10 that a slip is set and no bit depth information should be processed, regardless of the hook load changes. This unique feature has proved to be very important for reliable depth measurement and prevents confusing information affecting the depth measurement. When the slip is set, and the tong has broken the connection, the Kelley is picking up a new length of pipe to join on to the previous length and the drilling process continues.

The invention allows the parameters of interest to be derived from a limited number of sensors entirely without moving parts, thus giving improved reliability and low maintenance costs. Since the system replaces a number of conventional instruments, the initial cost is also competitive.

I claim:

1. In a drilling rig having a derrick including a crown block having a fast line pulley and a travelling block operable to lift pipe lengths to assemble and disassemble a drill string, and a rotary table engageable with the drill string to rotate it, an improved instrumentation system comprising:

a weight transducer mounted to provide a weight signal which is a function of the weight of the drill string on the rig;

a sensing means for providing at least a movement signal representative of the amount of movement of the travelling block, said sensing means detecting the movement of the crown block fast line pulley;

clock means providing a timing signal;

calculating means connected to receive the weight signal, the movement signal and the timing signal to calculate therefrom the weight on bit and rate of penetration;

said calculating means having a memory for storing data defining the relationship between the length and weight of the drill string, said calculating means including means to calculate true drilling depth from the weight signal, the movement signal and said stored data; and a unitary display means responsive to said calculating means to make all of said signals and the calculations calculated by said calculating means available to an operator, wherein the sensing means comprises a plurality of magnet means substantially inwardly disposed with respect to the rim of the fast line pulley and equispaced about said fast line pulley, and a sensor unit also substantially inwardly disposed with respect to the rim of the fast line pulley responsive to passage of said plurality of magnet means, said sensor unit including further means for producing a pulse signal representative of said movement signal and a signal indicative of the direction of movement.

2. The system of claim 1, further including input means disabling the weight signal during addition or removal of pipe.

3. The system of claim 1, in which the sensing means detects rotation of a drill pipe hoisting pulley.

4. The system of claim 1, including means detecting movement of the travelling block and supplying a signal representative thereof to the calculating means, the latter including means to produce an alarm signal if the travelling block approaches unduly closely to a fixed part of the system.

5. The system of claim 1 where said sensor unit includes three magnetic field detectors sequentially disposed adjavent said fast line pulley where actuation of the detectors in a first sequence is representative of movement of the travelling block in a first direction and actuation thereof in a sequence opposite to that of said first sequence is representative of movement of the block in a second direction opposite to that of the first direction.

6. In a drilling rig having a derrick including a crown block having a fast line pulley and a travelling block operable to lift pipe lengths to assemble and disassemble a drill string, and a rotary table engageable with the drill string to rotate it, an improved instrumentation system comprising:

a weight transducer mounted to provide a weight signal which is a function of the weight of the drill string on the rig;

sensing means for providing at least a movement signal representative of the amount of movement of the travelling block, said sensing means detecting the movement of the crown block fast line pulley;

clock means providing a timing signal;

calculating means connected to receive the weight signal, the movement signal and the timing signal to calculate therefrom the weight on bit and rate of penetration;

said calculating means having a memory for storing data defining the relationship between the length and weight of the drill string, said calculating means including means to calculate true drilling depth from the weight signal, the movement signal and said stored data; and a unitary display means responsive to said calculating means to make all of said signals and the calculations calculated by said calculating means available to an operator, wherein said sensing means comprises paint markers substantially inwardly disposed with respect to the rim of the fast line pulley and equispaced about said fast line pulley, and a paint nark photocell detector unit also substantially inwardly disposed with respect to the rim of the fast line pulley responsive to the passage of said marks, said photocell detector unit including further means for producing a pulse signal representative of said movement signal, and a signal indicative of the direction of movement of the travelling block.

7. The system of claim 6 where said photocell detector unit includes photosensitive detectors sequentially disposed adjacent said fast line pulley where actuation of the detectors in a first sequence is representative of movement of the travelling block in a first direction and actuation thereof in a sequence opposite that of said first sequence is representative of movement of the block in a second direction opposite to that of the first direction.

8. The system of claim 6, further including input means disabling the weight signal during addition or removal of pipe.

9. The system of claim 6, in which the sensing means detects rotation of a drill pipe hoisting pulley.

10. The system of claim 6, including means detecting movement of the travelling block and supplying a signal representative thereof to the calculating means, the latter including means to produce an alarm signal if the travelling block approaches unduly closely to a fixed part of the system.

* * * * *